US011826765B2

(12) United States Patent
Luo

(10) Patent No.: US 11,826,765 B2
(45) Date of Patent: Nov. 28, 2023

(54) SPRINKLER HEAD NOZZLE ASSEMBLY WITH ADJUSTABLE ARC, FLOW RATE AND STREAM ANGLE

(71) Applicant: K-RAIN MANUFACTURING CORP., Riviera Beach, FL (US)

(72) Inventor: Danhui Luo, Lake Worth, FL (US)

(73) Assignee: K-RAIN MANUFACTURING CORP., Riviera Beach, FL (US)

( * ) Notice: Subject to any disclaimer, the term of this patent is extended or adjusted under 35 U.S.C. 154(b) by 203 days.

(21) Appl. No.: 17/154,553

(22) Filed: Jan. 21, 2021

(65) Prior Publication Data

US 2021/0237104 A1 Aug. 5, 2021

Related U.S. Application Data

(60) Provisional application No. 62/968,509, filed on Jan. 31, 2020.

(51) Int. Cl.

| | |
|---|---|
| ***B05B 1/26*** | (2006.01) |
| ***B05B 3/04*** | (2006.01) |
| *B05B 15/74* | (2018.01) |

(52) U.S. Cl.
CPC ..... *B05B 1/262* (2013.01); *B05B 3/0431* (2013.01); *B05B 3/0454* (2013.01); *B05B 15/74* (2018.02)

(58) Field of Classification Search
CPC ..... B05B 1/262; B05B 3/0431; B05B 3/0454; B05B 15/74
USPC ..... 239/222.11, 222.17, 222.21
See application file for complete search history.

(56) References Cited

U.S. PATENT DOCUMENTS

2012/0292403 A1* 11/2012 Hunnicutt ..... B05B 1/304 239/222.17

* cited by examiner

*Primary Examiner* — Christopher S Kim
(74) *Attorney, Agent, or Firm* — Amster, Rothstein & Ebenstein LLP

(57) ABSTRACT

A sprinkler head nozzle assembly in accordance with an embodiment of the present invention includes an adjustable nozzle operable to extend and reduce an arcuate opening wherein the size of the arcuate opening indicates the arc of coverage of the sprinkler head nozzle assembly and a rotating distributor, mounted on a central shaft extending through the housing and the nozzle member, and operable to deflect a flow of water from the arcuate opening out of the nozzle assembly.

12 Claims, 16 Drawing Sheets

SPRINKLER HEAD NOZZLE ASSEMBLY WITH ADJUSTABLE ARC, FLOW RATE AND STREAM ANGLE

CROSS REFERENCE TO RELATED APPLICATIONS

The present application claims benefit of and priority to U.S. Provisional Patent Application Ser. No. 62/968,509 entitled SPRINKLE HEAD NOZZLE ASSEMBLY WITH ADJUSTABLE ARC, FLOW RATE AND STREAM ANGLE filed Jan. 31, 2020, the entire content of which is hereby incorporated by reference herein.

BACKGROUND

Field

The present application relates to a sprinkler head nozzle assembly that includes a rotating distributor and provides for adjustment of arc of coverage and flow rate.

Description of the Art

U.S. Pat. No. 4,867,378 discloses a sprinkler having an adjustable arc of coverage rotating nozzle with the arc of coverage being settable and indicated on the outside of the sprinkler. The market advantages for a sprinkler whose arc of coverage can be easily set are discussed in this patent, the entire disclosure of which is hereby incorporated herein by reference. The sprinkler of the '378 patent was for large area coverage, long throw radius, oscillating sprinklers.

U.S. Pat. No. 5,148,990 discloses providing an adjustable and indicated arc of coverage for smaller and intermediate area of coverage sprinklers which can be fixed spray or rotating distributing heads that provide a plurality of streams for intermediate ranges and allow for adjustment of arc of coverage that automatically provides the same precipitation rate over the entire range of coverage. U.S. Pat. No. 6,814,304 discloses a speed control frictional brake that includes axial movement for varying flow rates and supply pressure to maintain a substantially constant rotational speed. U.S. Pat. Nos. 7,168,634 and D527,791 are also related patents covering other features of this type of sprinkler.

U.S. Pat. Nos. 4,815,662; 4,898,332; 4,986,474; 6,651,905 are reference patents that disclose adjustable arc and/or adjustable flow rate sprinklers where the distributor rotational speed is viscous damped. A significant shortcoming of these references is that the water distribution sub-assembly, nozzle sub-assembly and flow adjustment sub-assembly all pop up during operation, and return after water source is turned off, which is complicated and costly to manufacture. Other related U.S. patents include U.S. Pat. Nos. 5,058,806; 5,288,022; 6,244521; 6,499,672; 6,651,905; 6,688,539; 6,736,332; 7,032,836; 4,842,201; 4,867,379; 4,898,332; 4,967,961.

U.S. Pat. No. 5,588,594 shows a stepped spiral arc settable spray nozzle where an arcuate slot valve is opened toward the center and the flow of water is directed upward onto a rotating distributor, and thereafter, deflected outward to provide coverage around the sprinkler.

U.S. Pat. No. 4,579,285 teaches the use of axially stepped spirals to provide an adjustable arcuate spray nozzle, but does not disclose or teach configuring the valve to be able to discharge directly onto a rotating deflector and still be able to adjust the arc of coverage. Also, there is no upstream proportional throttling provided in this reference which may result in undue pressure being applied to the arcuate valve for a desired range or flow rate.

U.S. Pat. No. 6,834,816, which is hereby incorporated by reference herein, discusses the benefits of a selected range arc settable spray nozzle with preset precipitation rate as set by the upstream proportional throttling valve which allows establishment of the upstream pressure to the arc settable valve which thus establishes a flow rate and resulting precipitation rate of the sprinkler as well as range of coverage due to its effect on discharge velocity from the sprinkler. The arc of coverage adjustment is coupled to an upstream flow throttling valve so that as the arc of coverage is adjusted, the opening of the upstream flow throttling valve is proportionally adjusted to maintain the precipitation rate and range of coverage substantially constant throughout the full range of arc of coverage settings of the valve arc settable stepped spiral discharge valve.

Accordingly, it would be beneficial to provide a sprinkler head nozzle assembly that avoids the problems noted above.

SUMMARY

A sprinkler head nozzle assembly includes a nozzle element with an adjustable two part structure that allows for adjustment of a length of an arcuate opening that sets the arc of coverage of the sprinkler nozzle assembly. The nozzle assembly also includes a rotating distributor that is movable in an axial direction from a closed position to an open position during operation.

A sprinkler assembly in accordance with an embodiment of the present disclosure includes: a base; a nozzle element mounted in the base and including an arcuate opening through which a stream of water passes; an arc of coverage adjustment element mounted in the base and operatively connected to the nozzle element and accessible from an exterior of the nozzle assembly to expand and contract the arcuate opening in the nozzle element to adjust an arc of coverage provided by the stream of water provided by the nozzle element; a shaft extending through the base, the nozzle element, and the arc of coverage adjustment element and extending above the base, the shaft axially movable relative to the base; and a rotating distributor mounted on a top end of the shaft and rotatable with respect thereto, the rotating distributor positioned to receive the stream of water and distribute the water is outward and away from the nozzle assembly in the arc of coverage.

In embodiments, the nozzle element includes a lower stationary valve element including: a cylindrical lower portion; a conical upper portion, the conical upper portion including: a stepped and spiraled top surface; a radially extending rib; a disk shaped middle element including one or more openings formed therein around a portion of the disk shaped middle element; and an upper element rotatably mounted on the disk shaped middle element, the lower element including: a vertically extending element extending from a top surface of the lower element, wherein the vertically extending element rotates with the disk shaped middle element between a first position and a second position to vary a length of the arcuate opening defined between the vertically extending element and the radially extending rib to vary the arc of coverage of the sprinkler assembly.

In embodiments, the upper element is operatively connected to the arc of coverage adjustment element such that movement of the arc of coverage adjustment element moves the vertically extending element relative to the radially extending rib to expand and contract the arcuate opening.

In embodiments, the sprinkler assembly includes an interim arc adjustment mechanism positioned between and connected to the arc of coverage adjustment element and the upper element.

In embodiments, the interim arc adjustment mechanism is mounted in the base.

In embodiments, the interim arc adjustment mechanism includes: a vertically extending sidewall extending upward around a periphery of a top surface thereof and including at least one slot formed therein, the slot configured to receive a portion of the arc of coverage adjustment mechanism; and a horizontal flange extending inward around a central opening, the horizontal flange including at least one notch configured to receive a portion of the upper element such that the interim arc adjustment element rotates with the arc of coverage adjustment element and rotated the upper element.

In embodiments, the sprinkler assembly includes a flow control element operably connected to the base and accessible from an exterior of the nozzle assembly, the flow control element configured to adjust a flow of water to the nozzle element.

In embodiments, the shaft extends through the flow control element.

In embodiments, the flow control element includes: a lower stationary portion; and an upper rotatable ring mounted in the lower stationary portion such that rotation of the upper rotatable ring relative to the lower stationary portion adjusts an amount of water that flow to the nozzle element.

In embodiments, the lower stationary portion includes a lower portion including at least one first flow opening and the upper rotatable ring includes a lower portion include at least a second flow opening.

In embodiments, the upper rotatable ring is rotatable from a first position in which the first flow opening is aligned with the second flow opening to allow flow of water and a second position in which the first flow opening is out of alignment with the second flow opening to disrupt the flow of water.

DESCRIPTION OF THE EMBODIMENTS

Figure 1:
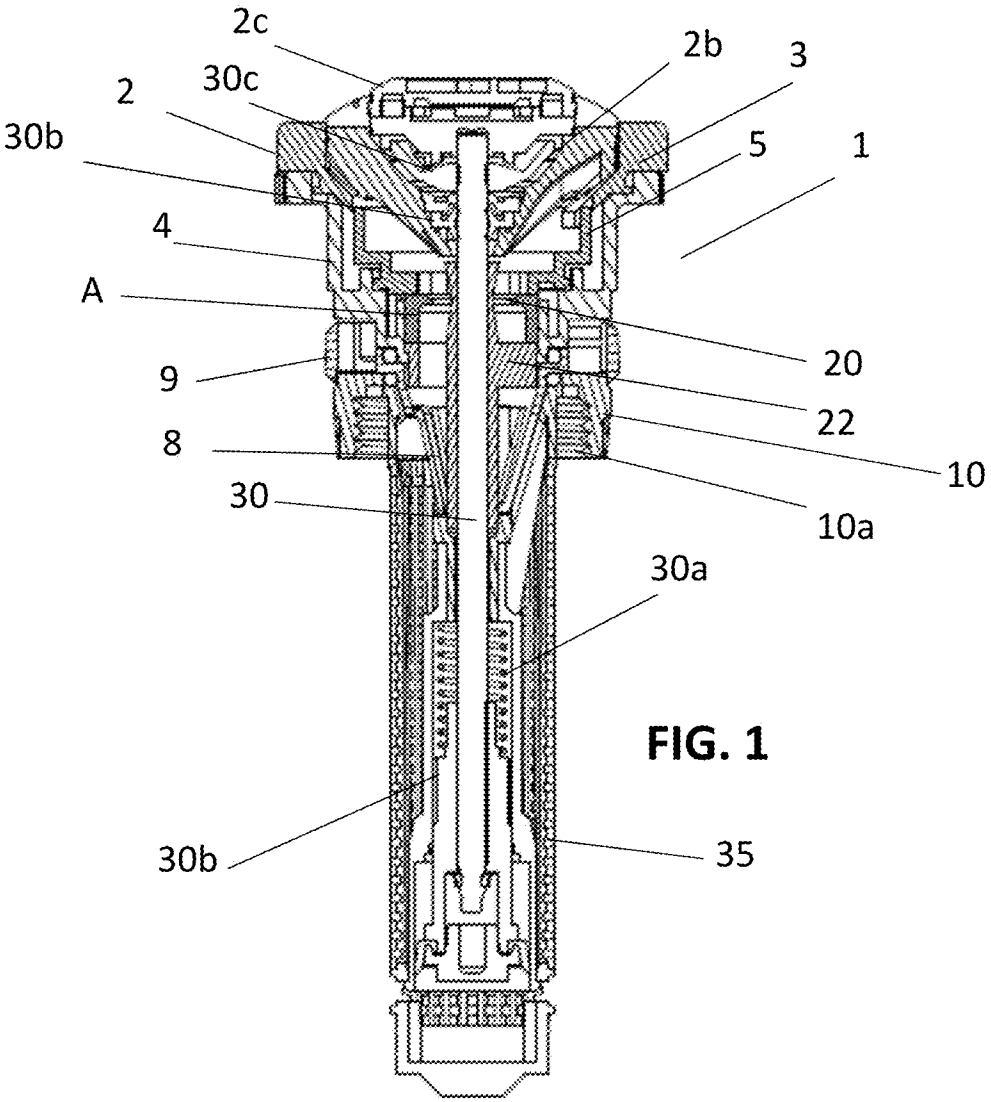
FIG. 1 shows a cross-sectional side elevation view of a sprinkler head nozzle assembly in accordance with an embodiment of the present invention.
Figure 1A:
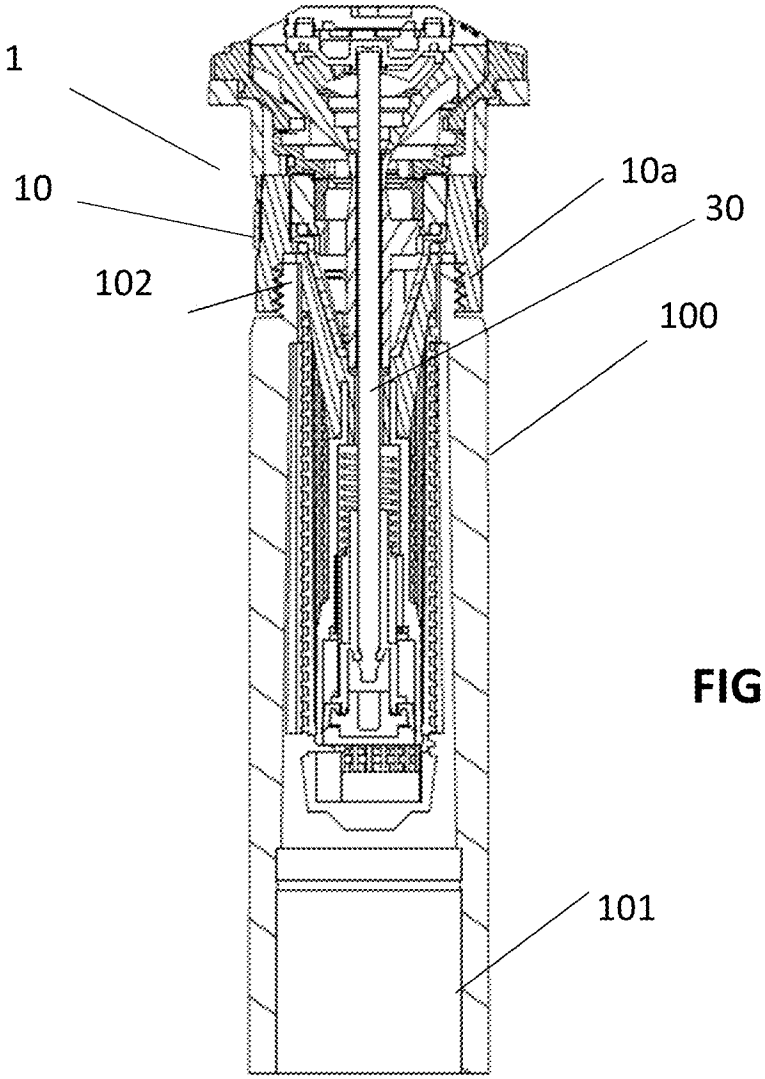
FIG. 1*a* illustrates a cross-sectional view of the sprinkler head nozzle assembly of FIG. 1 mounted in a sprinkler body in accordance with an embodiment of the present invention.
Figure 2:
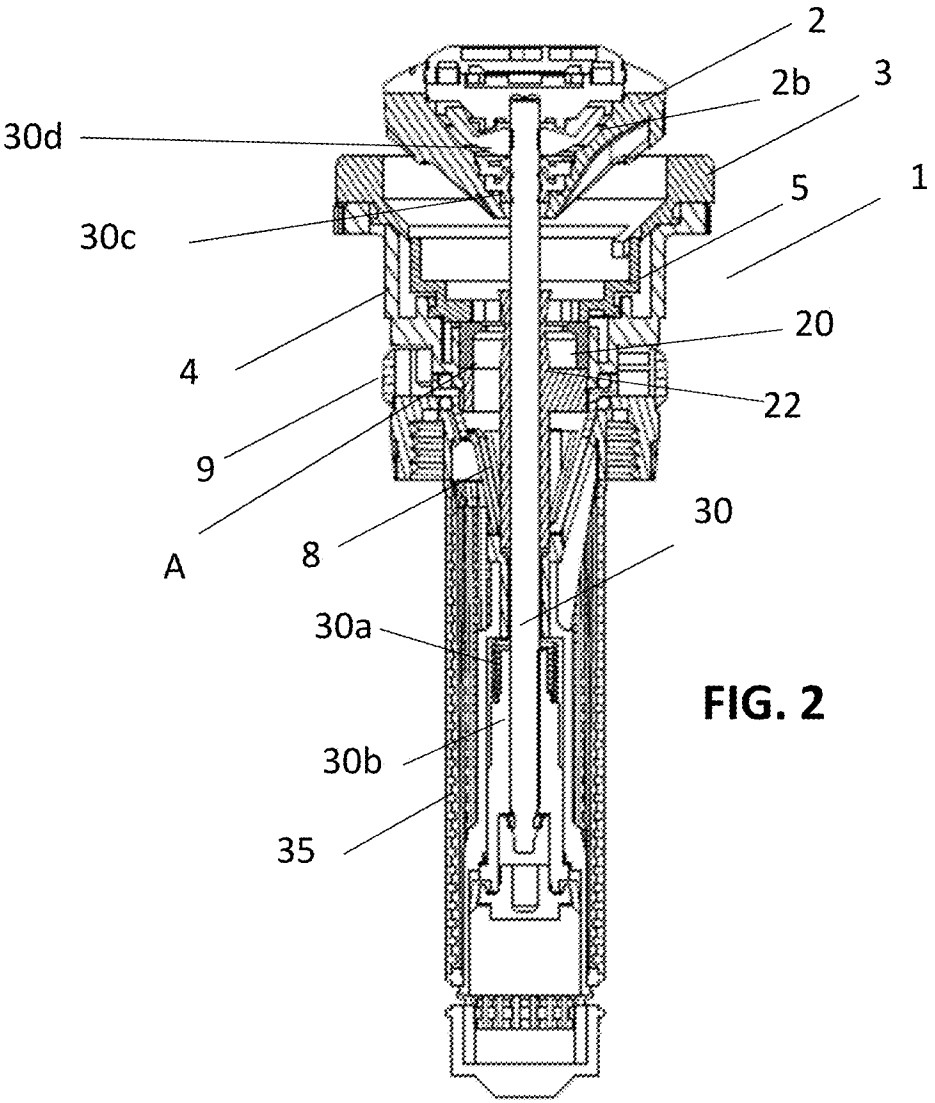
FIG. 2 shows a cross-sectional side elevation view of the sprinkler head nozzle assembly of FIG. 1 with a distributor in a raised position in accordance with an embodiment of the present invention.

An adjustable arc of coverage sprinkler assembly 1 in accordance with an embodiment of the present invention is shown in cross-section in FIGS. 1-2. In embodiments, the nozzle assembly 2 may be mounted in a sprinkler body 100 including an inlet 101 in fluid communication with a water supply (see FIG. 1A). In embodiments the nozzle assembly 1 may be mounted in the sprinkler body 100 and secured in place via interaction with the threads 102 provided around an outer surface of the top of the sprinkler body 100. In embodiments, the nozzle assembly 1 may be secured to the body 100 via the threads 10*a* provided on the inner surface of the collar 10. In embodiments, other securing elements may be used in place of the threads if desired. FIG. 1 illustrates an embodiment in which a distributor 2 of the nozzle assembly 1 is in a lowered, closed position. FIG. 2 illustrates the distributor 2 in a raised, open and operating position. In embodiments, the nozzle assembly 1 includes a base 4 with an adjustable arcuate opening A at a top thereof. In embodiments, different upper and lower elements 22, 20 may be provided in the base 4 to provide a full range of arc of coverage. In embodiments, for example, one assembly may provide a range of 90 degrees to 210 degrees, a second assembly may allow for a range between 210 degrees and 270 degrees and a third assembly may be used for an arc of coverage that covers 360 degrees. In embodiments, an arc adjustment ring 3 may be connected to the top of the body or housing 4 and rotates to adjust the length of arcuate opening A, and thus, sets the arc of coverage of the sprinkler in which the nozzle assembly 1 is used. In embodiments, such as in FIGS. 5*a*-5*b*, the arcuate opening A may be modified to provide an arc of coverage between 210 degrees and 270 degrees. In embodiments, as noted above, other assemblies, that is, different combinations of upper and lower elements 22, 20, may be provided to provide arcs of coverage over different ranges.

Figure 3:
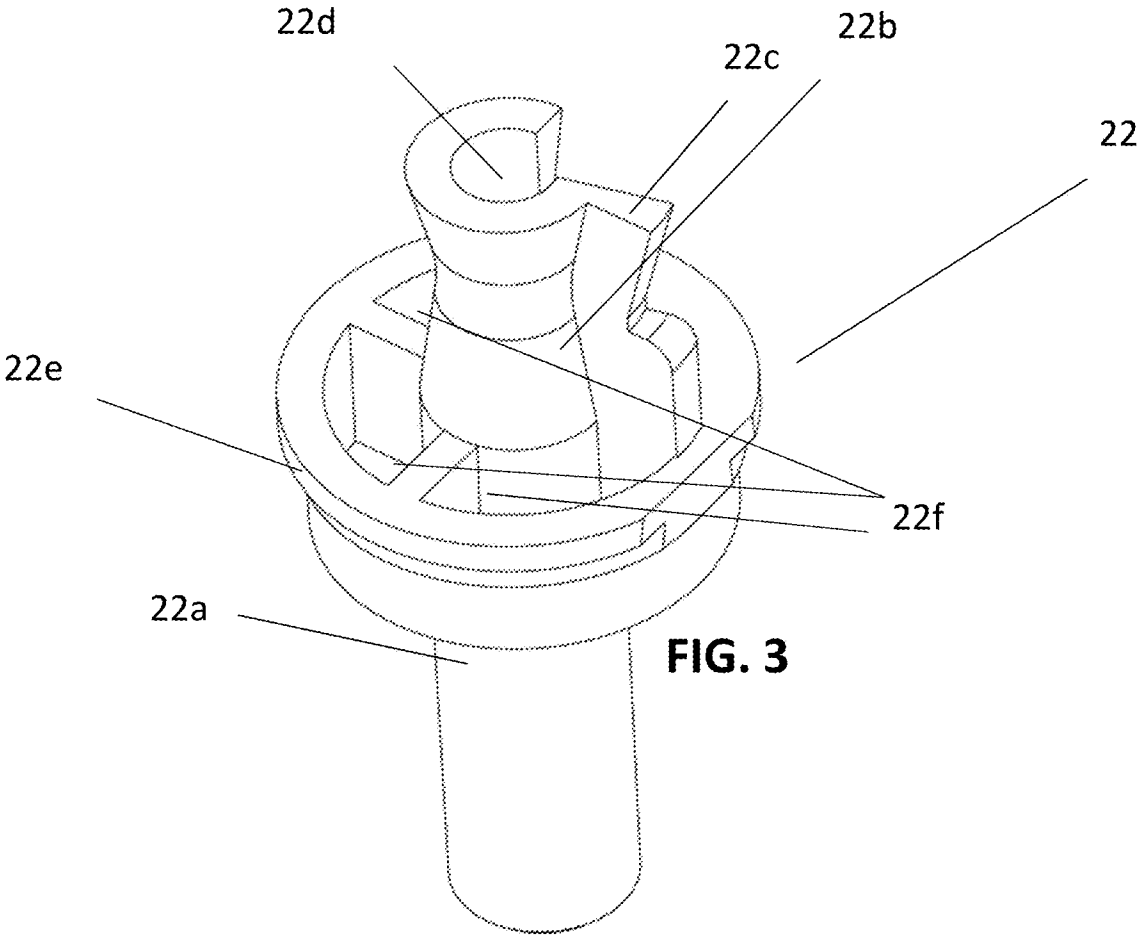
FIG. 3 illustrates a detailed view of a lower nozzle element of the sprinkler head nozzle assembly of FIG. 1 in accordance with an embodiment of the present invention.

In embodiments, the size (arcuate length) of the arcuate opening A is based on the interaction of the lower stationary valve element 22 and the movable upper valve element 20. FIG. 3 shows a detailed view of the lower valve element 22 configured to provide a 210 degree to 270 degree arc of coverage. In embodiments, the lower valve element 22 includes a cylindrical lower portion 22*a* with a conical upper portion 22*b*. In embodiments, the lower portion 22*a* need not be cylindrical and any other suitable shape may be used. In embodiments, a radial rib 22*c* extends from the conical upper portion 22*b* and marks one end of the opening A. A disk-like middle portion 22*e* may be provided between the upper and lower portions 22*b*, 22*a*. A central opening 22*d* may be provided through the length of the element 22 through which a shaft 30 extends. In embodiments, the disk-like middle portion may include one or more slots 22*f* formed therein that will allow water to pass therethrough. In the embodiment of FIG. 3, these slots are provided to allow for an arc of coverage of between 210 degrees and 270 degrees.

Figure 4:
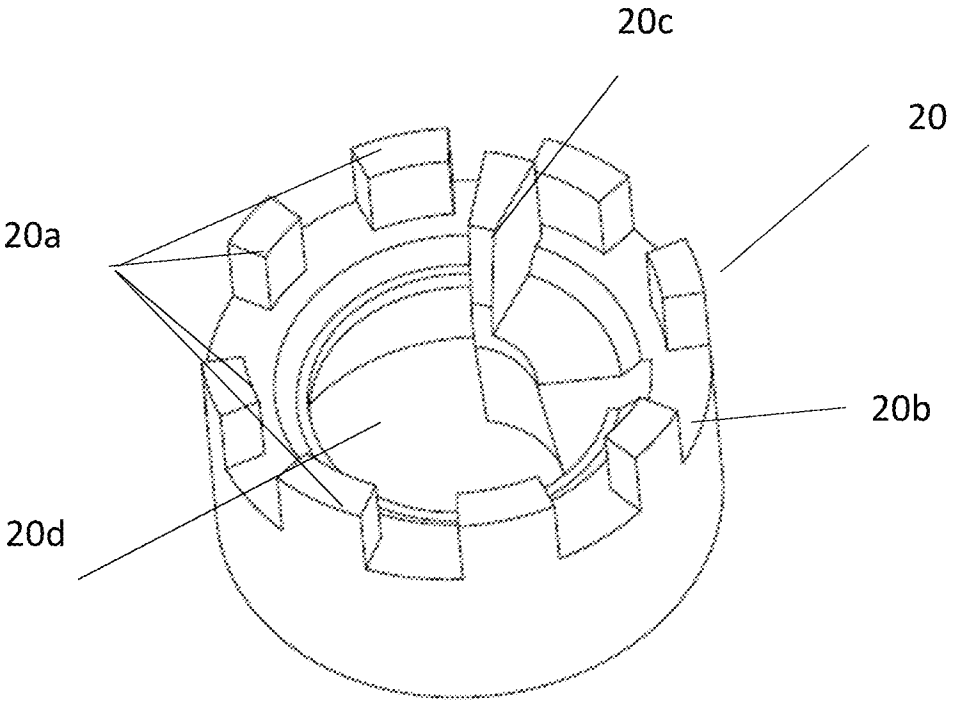
FIG. 4 illustrates a detailed view of an upper nozzle element of the sprinkler head nozzle assembly of FIG. 1 in accordance with an embodiment of the present invention.
Figure 5:
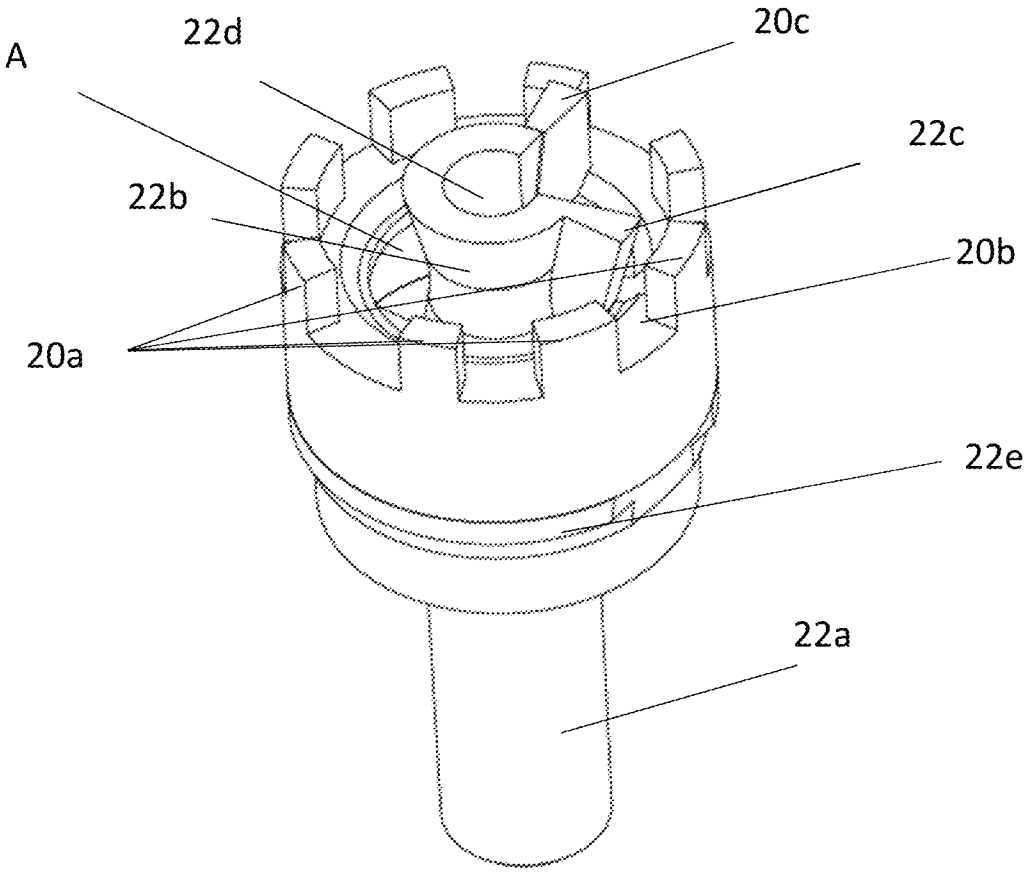
FIG. 5 illustrates a detailed view of the upper nozzle element mounted on the lower nozzle element in accordance with an embodiment of the present invention.

FIG. 4 shows a detailed view of an embodiment of the upper valve element 20 which is also configured to provide a 210 degree to 270 degree arc of coverage in combination with the lower valve element 22 discussed above. In embodiments, an upper rib 20*c* may be provided on the top surface 20*b* thereof and provides the opposite end of the arcuate opening A, opposite the radial rib 22*c*. In embodiments, the top surface 20*b* also includes a plurality of engagement ridges 20*a* positioned around a perimeter of the top surface 20*b* and generally extending upward. In embodiments, the upper element 20 is substantially cylindrical in shape with an open center 20*d* through which the top portion 22*a* of the lower element 22 and the shaft 30 pass. In embodiments, the upper element 20 may be any other suitable shape. In embodiments. The upper element 20 sits on the upper surface of the middle disk-like portion 22*e* of the lower element 22 as can be seen in FIG. 5, for example. In embodiments, water flows between an outer surface of the lower element 22 and inner surface of the upper element 20 between the rib 22*c* and the rib 20*c* through the arcuate opening A. In embodiments, rotation of the upper element 20 relative to the stationary lower element 22 adjusts the position of the rib 20*c* relative to the rib 22*c* to change the arcuate length of the opening A and the arc of coverage provided by the assembly 1. In embodiments, varying the arcuate length of the opening A will change the arc of coverage provided by the nozzle assembly 1.

Figure 5A:
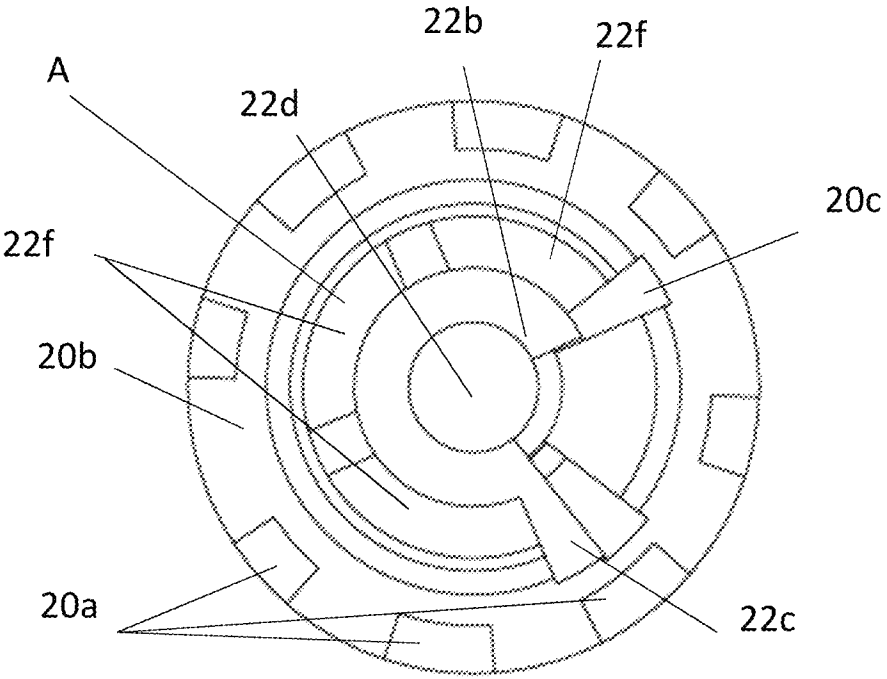
FIG. 5*a* illustrates a top view of the upper and lower nozzle elements positioned to provide an arc of coverage of 270 degrees.
Figure 5B:
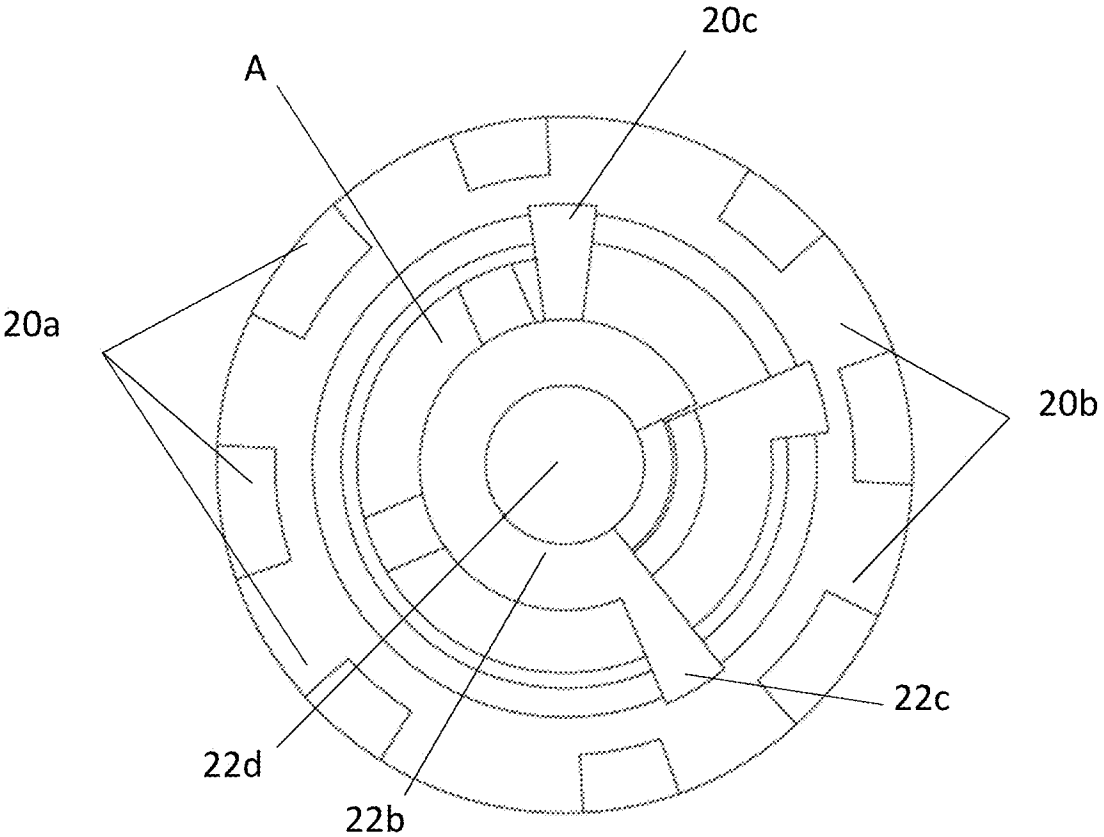
FIG. 5*b* illustrates a top view of the upper and lower nozzle elements positioned to provide an arc of coverage of 210 degrees.
Figure 6:
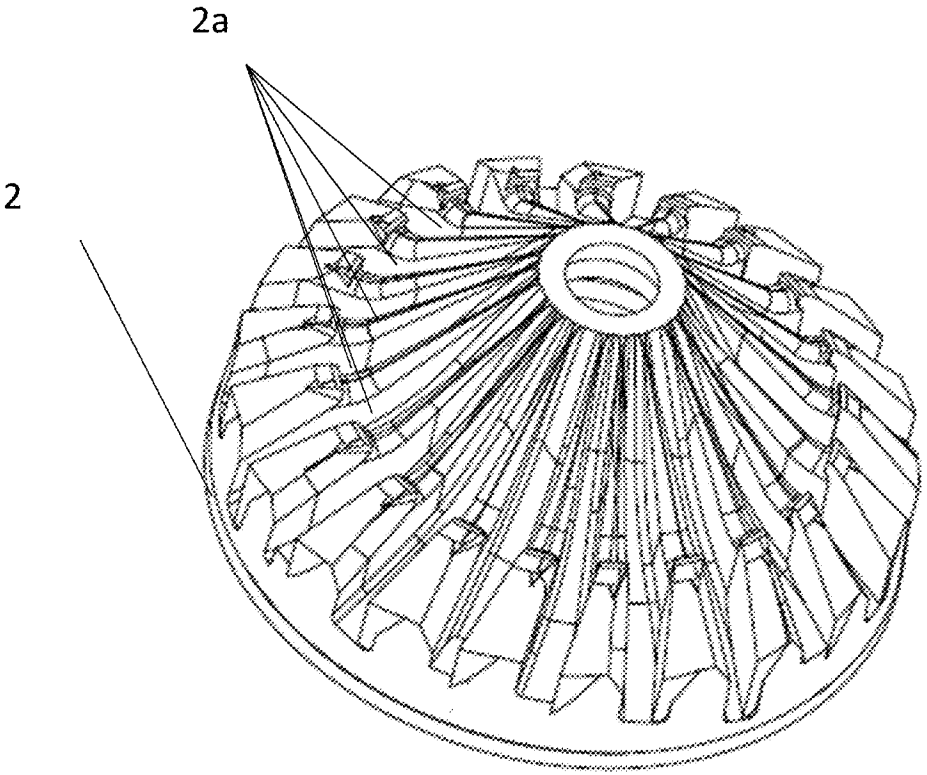
FIG. 6 illustrates a bottom view of the distributor of the sprinkler head nozzle assembly in accordance with an embodiment of the present invention.
Figure 8:
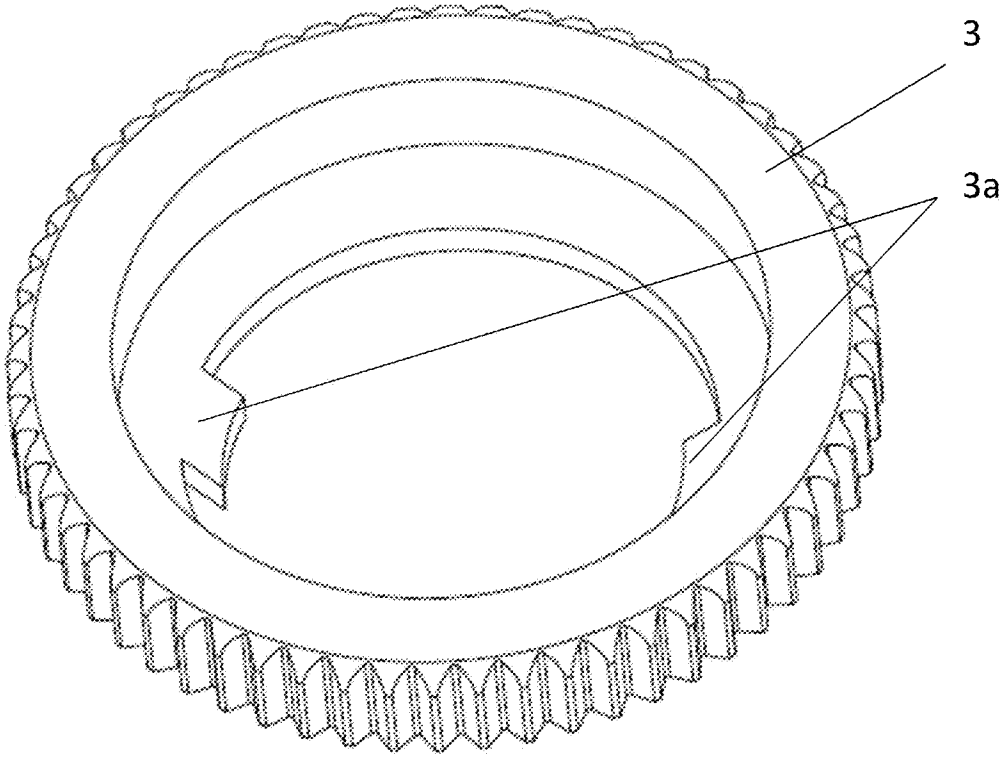
FIG. 8 illustrates an arc adjustment ring of the sprinkler head nozzle assembly in accordance with an embodiment of the present invention.
Figure 9:
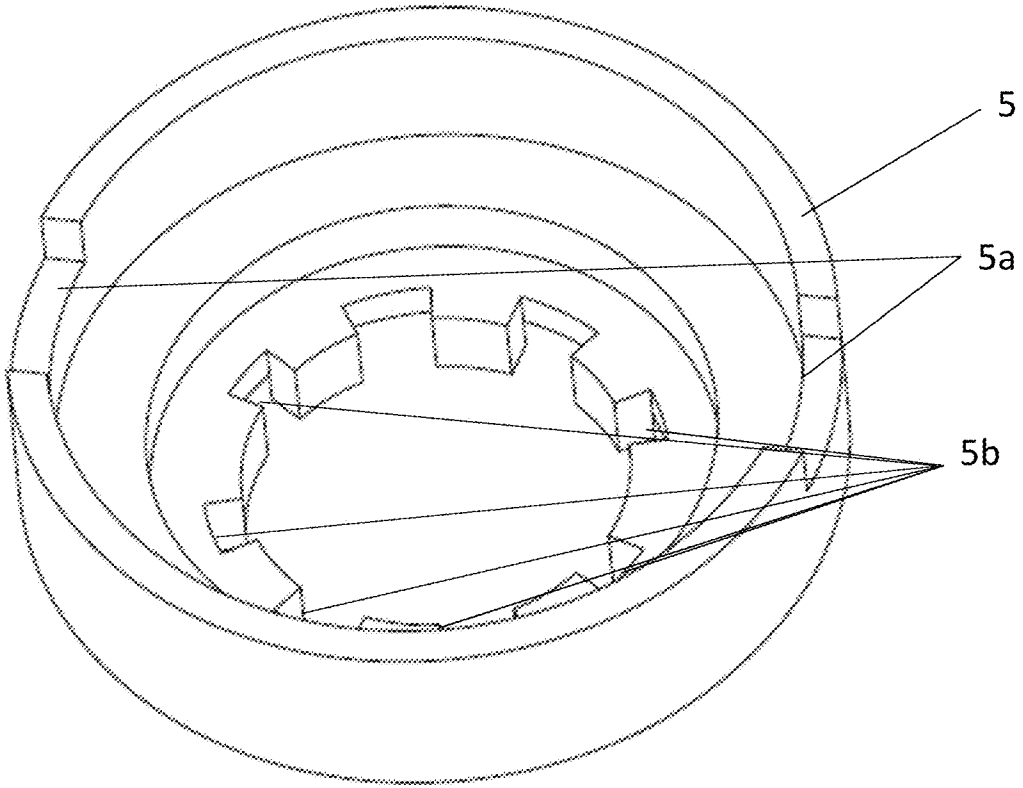
FIG. 9 illustrates an intermediate arc drive component of the sprinkler head nozzle assembly in accordance with an embodiment of the present invention.
Figure 10:
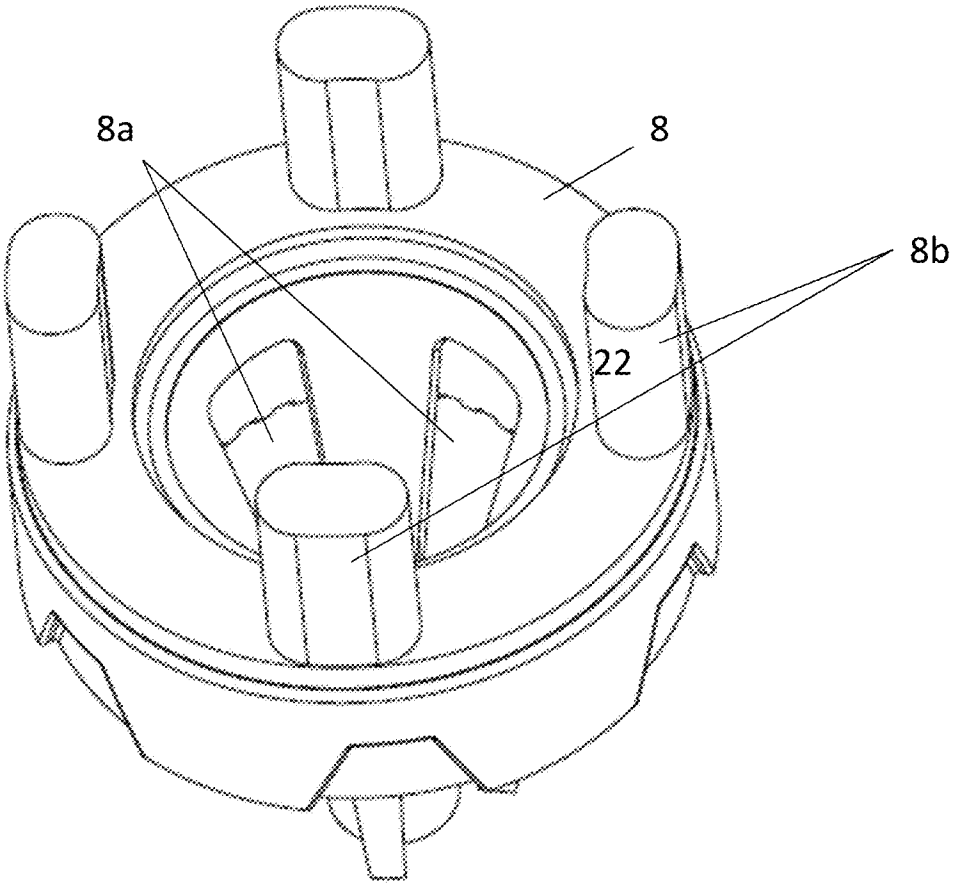
FIG. 10 illustrates a body of the sprinkler head nozzle assembly in accordance with an embodiment of the present invention.

FIG. 5 illustrates a detailed view of the upper element 20 mounted on the lower element 22. FIG. 5*a* shows a top view of the upper element 20 and lower element 22 where the arcuate opening A is set to provide an arc of coverage of 270 degrees. As noted above, the upper element 20 and lower element 22 may be provided in different combinations to vary the arcuate length of the opening A. FIG. 5*b* shows a top view of upper and lower elements 20, 22 with the opening A set for an arc of coverage of 210 degrees. As can be seen in FIGS. 5*a* and 5*b*, as the upper element 20 rotates relative to the element 22 which remains stationary, the opening A changes in size to provide an arc of coverage between 270 degrees and 210 degrees. In embodiments, the upper valve element 20 is rotated via the arc adjustment ring 3 which is accessible from an exterior of the nozzle assembly 1. In embodiments, the arc adjustment ring 3 may be operatively connected to an interim arc adjustment element 5 such that rotation of the ring 3 rotates the interim arc adjustment element 5. In embodiments, as can be seen in FIG. 8, the arc adjustment ring 3 may include two inwardly extending protrusions 3*a* extending from an inner surface thereof. While FIG. 8 illustrates two protrusions 3*a*, fewer or more protrusions may be used. In embodiments, the protrusions 3*a* are received in slots 5*a* (see FIG. 9, for example) formed in a top lip of the interim arc adjustment element 5 such that rotation of the ring 3 will also rotate the element 5. In embodiments, fewer or more slots 5*a* may be provided for interaction with the protrusions 3*a*. In embodiments, the interim arc adjustment element 5 preferably includes a plurality of notches 5*b* formed around an inner opening thereof. In embodiments, the notches 5*b* may receive the engagement ridges 20*a* formed on the upper element 20 such that the upper element 20 will rotate with the interim arc adjustment element 5 to adjust the arcuate length of the opening A.

Figure 11:
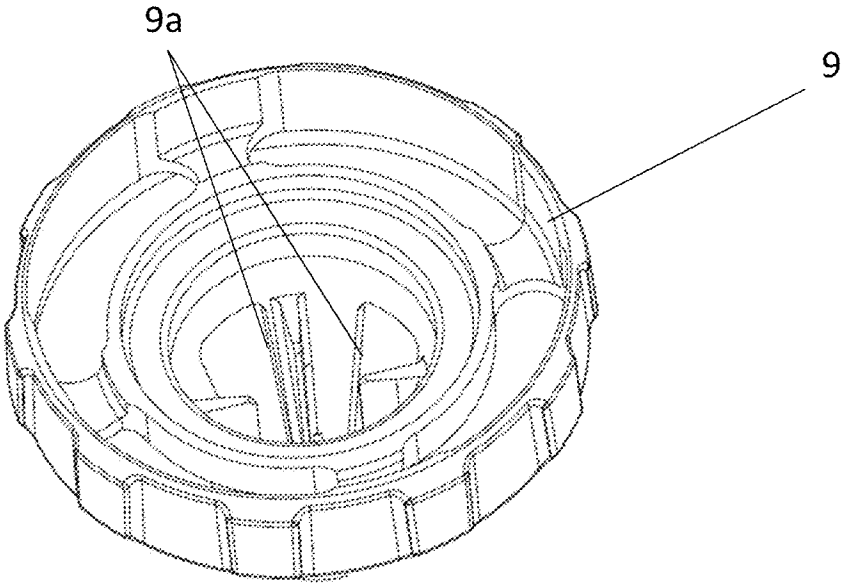
FIG. 11 illustrates a flow adjustment element of the sprinkler head nozzle assembly in accordance with an embodiment of the present invention.
Figure 12:
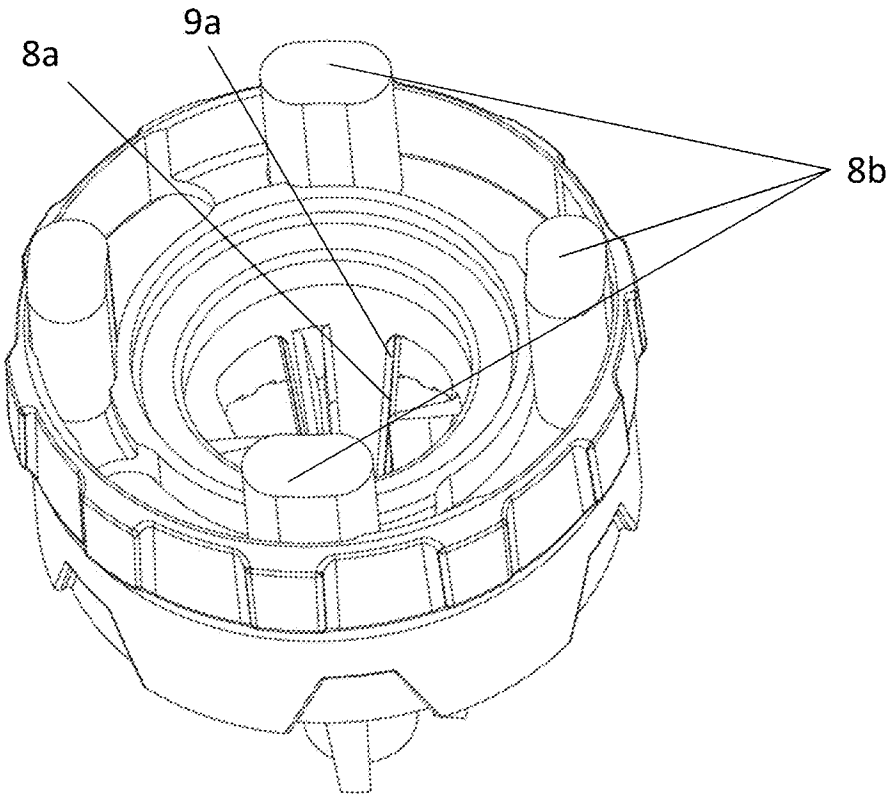
FIG. 12 illustrates the flow adjustment element of FIG. 10 mounted in the body of the sprinkler head nozzle assembly of FIG. 11 in an open position.
Figure 13:
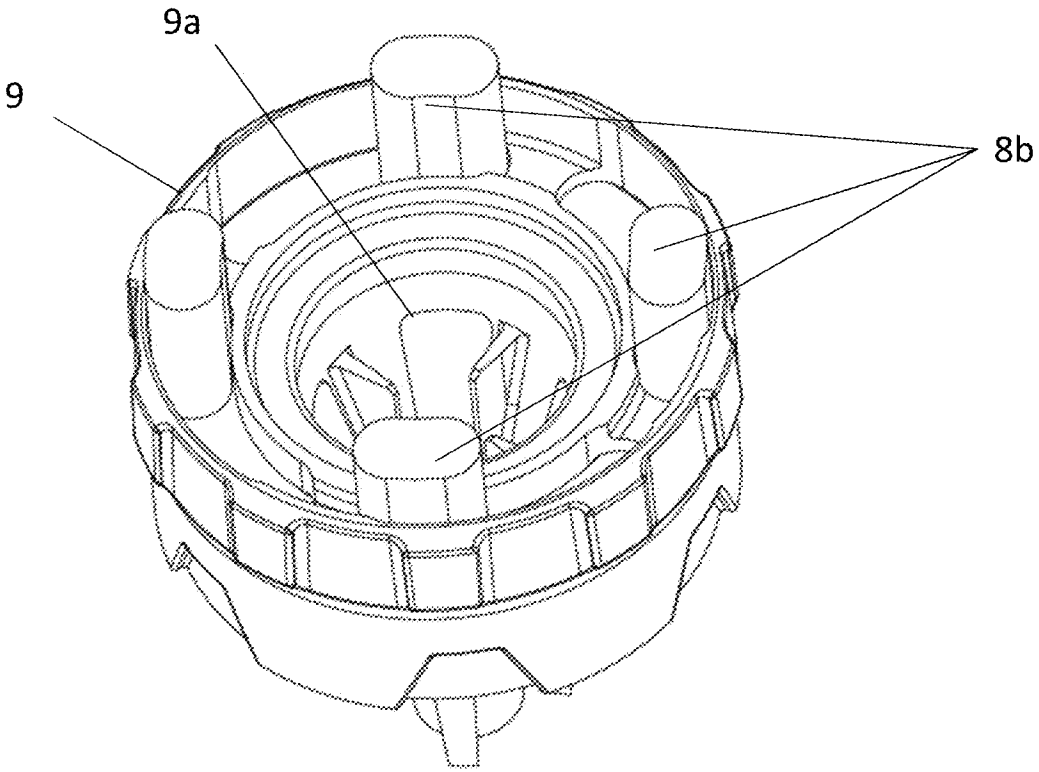
FIG. 13 illustrates the flow adjustment element of FIG. 10 mounted in the body of the sprinkler head nozzle assembly of FIG. 11 in a closed position.

In embodiments, a flow control ring 9 may be provided upstream of the upper and lower elements 20, 22 and is adjustable to adjust a flow of water thereto. In embodiments, as indicated in FIG. 11, for example, the flow control ring 9 may include a bottom element with a plurality of flow openings 9*a* formed therein. In embodiments, the base 4 includes a body element 8 extending from a bottom portion thereof that receives the lower portion of the control ring 9. The base 8 may include a plurality of body flow openings 8*a*. The flow control ring 9 may be rotated to bring the flow openings 9*a* into alignment with the body flow openings 8*a* to allow substantially free flow of water through the openings 8*a*, 9*a* (see FIG. 12, for example). In embodiments, the flow control ring 9 may also be rotated in the opposite direction to move the openings 9*a* out of alignment with the openings 8*a* to reduce the flow of water the upper and lower nozzle elements. FIG. 12 illustrates an exemplary embodiment in which the openings 9*a* and 8*a* are aligned and FIG. 13 illustrates an exemplary embodiment in which the openings 9*a* and 8*a* and out of alignment and the flow of water is shut off.

Figure 7:
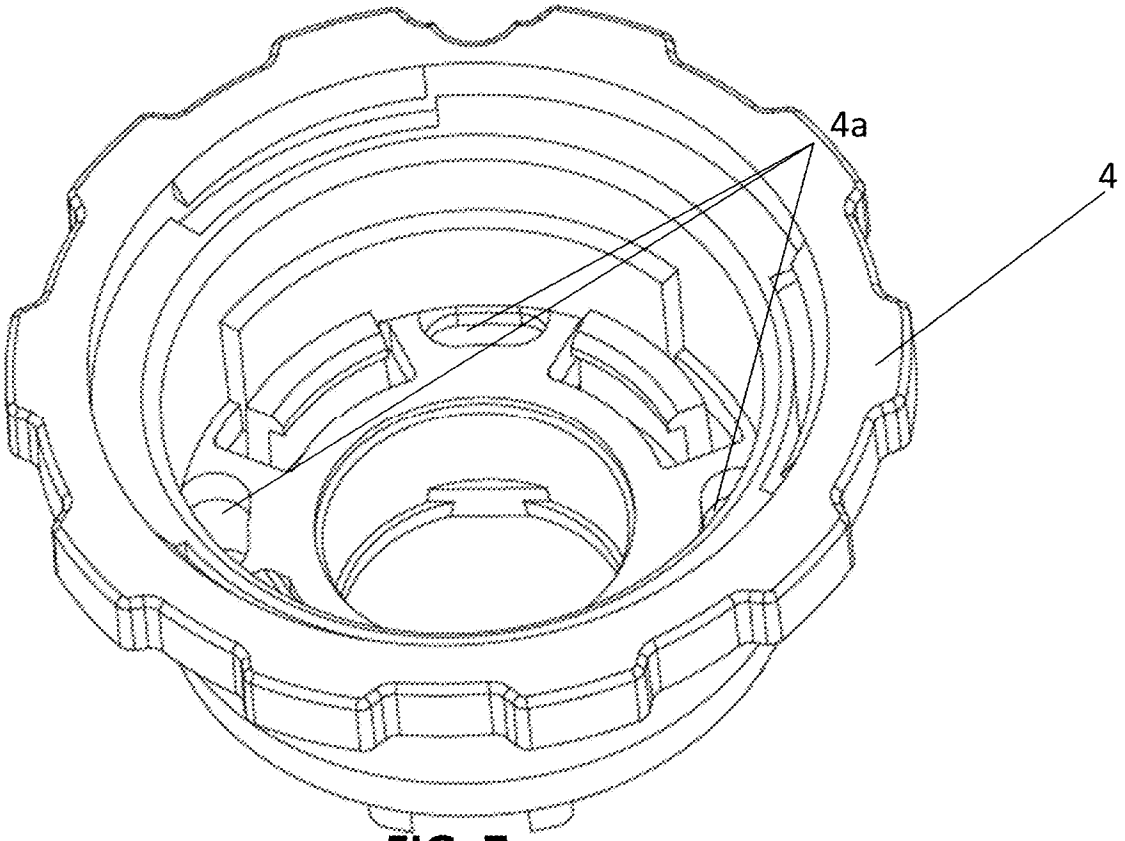
FIG. 7 illustrates a base of the sprinkler head nozzle assembly in accordance with an embodiment of the present invention.

In embodiments, the base 8 is held stationary via connection to the body 4. In embodiments, the body 4 may include a plurality of securing slots 4*a* formed in a lower internal flange 4*b* thereof (see FIG. 7). In embodiments, the base element 8 may include a plurality of stakes 8*b* that extent up from a top surface thereof through the securing slots 4*a* such that the base 8 is held in place as the ring 9 rotates.

In embodiments, the shaft 30 extends through the elements 20 and 22, the body 4, the base 8 and the flow control ring 9. In embodiments, the distributor 2 may be mounted on a top of the shaft 30 and both are movable axially from the closed position of FIG. 1 to the open position of FIG. 2. In embodiments, the shaft 30 and the distributor 2 may be biased into the closed position via biasing element 30*a*. In embodiments, a stopper 30*b* may be provided at a bottom of the shaft 30 to limit upward movement of the shaft 30 and distributor 2. In embodiments, the end of the shaft 30 and the stopper 30*b* may be mounted in a filter basket 35. In embodiments, the filter basket 35 may not be used.

In operation, water passes through the filter basket 35 (when provided) and through the openings 9*a*, 8*a*, which may or may not be used control flow based on their alignment. Water then flows upward between the lower element 20 and the upper element 22, along the conical outer surface of the top portion 22*b* of the lower element 22 through arcuate opening A. The water the projects upward onto a bottom surface of the distributor 2. In embodiments, the force of the water lifts the distributor 2 and the shaft 30 axially upward and into the opening position of FIG. 2. As noted above, the stopper 30*a* may limit upward movement of the distributor and shaft. The water striking the distributor 2 passes through the channels 2*a* and flows through them from the central portion of the distributor 2 to the outer periphery where the water continues to flow as a plurality of streams from the assembly 1. The channels 2*a* are curved and shaped to direct water out of the assembly 1 in the plurality of streams. In embodiments, the water imparts rotation to the distributor 2 as it flows through the curved channels 2*a*. When the water is turned off, the biasing element 30*a* pulls the distributor 2 back into the closed position of FIG. 1. In this closed position, the distributor 2 is protected from mechanical damage and clogs.

In embodiments, the distributor 2 may include a viscous braking chamber 2*b* to control the speed of rotation of the distributor as it rotates. A bearing 30*b* may be provided at a bottom of the chamber through which the shaft 30 passes to allow the distributor 2 to rotate relative to the rod. A stator 30*c* is preferably provided above the bearing 30*b* and secured to the rod such that it remains stationary with the rod as the distributor 2 rotates. A cap 2*c* may be provided on top of the distributor 2 defining a top of the chamber 2*b*. In embodiments, the chamber 2*b* includes or is filled with a viscous fluid. In embodiments, as the distributor 2 rotates, viscous dampening occurs between the stator 30*c* and the walls of the chamber 2*b* which limits the speed of rotation. The faster the distributor 2 spins, the higher the viscous dampening force limits the speed of rotation of the distributor 2.

In embodiments, the conical top portion 22*b* of the lower nozzle element 22 is shaped to optimize the flow of water to the distributor 2. In embodiments, the conical shape of the upper portion 22*b* of the lower nozzle element 22 provides for a conical flow of water to the distributor 2 which may be optimized such that the water strikes the distributor in a preferred area and at a preferred angle to maximize flow and a smooth output in the streams. In embodiments, it is preferable that the water stream strike the bottom surface of the distributor 2 in the area that is about 20-30% of the length of the channel 2*a* away from the inner or bottom end of the channel at an angle of about 10 to 15 degrees.

The sprinkler head assembly 1 of the present disclosure provides adjustment of the arc of coverage and flow control while also providing a conical nozzle to optimize the flow of water provided to the distributor 2. Further, only the distributor 2 and shaft 30 rise up and down such that the assembly 1 is simpler and less expensive to produce than conventional assemblies. The sprinkler nozzle head assembly 1 thus provides for reliable operation and allows for water conservation.

What is claimed is:

1. A sprinkler assembly comprises:

a base;

a nozzle element mounted in the base and including an arcuate opening through which a stream of water passes;

an arc of coverage adjustment element mounted in the base and operatively connected to the nozzle element and accessible from an exterior of the sprinkler assembly to expand and contract the arcuate opening in the nozzle element to adjust an arc of coverage provided by the stream of water provided by the nozzle element;

a shaft extending through the base, the nozzle element, and the arc of coverage adjustment element and extending above the base, wherein the shaft is mounted to be axially movable relative to the base, the nozzle element and the arc of coverage adjustment element, such that the shaft moves upward and downward independent of the nozzle element and the arc of coverage adjustment element; and a rotating distributor mounted on a top end of the shaft and rotatable with respect thereto, the rotating distributor positioned to receive the stream of water and distribute the water outward and away from the nozzle assembly in the arc of coverage.

2. The sprinkler head nozzle assembly of claim 1, wherein the nozzle element further comprises:

a lower stationary valve element including:

a cylindrical lower portion;

a conical upper portion, the conical upper portion including:

a stepped and spiraled top surface;

a radially extending rib;

a disk shaped middle element including one or more openings formed therein around a portion of the disk shaped middle element; and an upper element rotatably mounted on the disk shaped middle element, the upper element including:

a vertically extending element extending from a top surface of the upper element, wherein the vertically extending element rotates between a first position and a second position to vary a length of the arcuate opening defined between the vertically extending element and the radially extending rib to vary the arc of coverage of the sprinkler assembly.

3. The sprinkler assembly of claim 2, wherein the upper element is operatively connected to the arc of coverage adjustment element such that movement of the arc of coverage adjustment element moves the vertically extending element relative to the radially extending rib to expand and contract the arcuate opening.

4. The sprinkler assembly of claim 3, further comprising an interim arc adjustment mechanism positioned between and connected to the arc of coverage adjustment element and the upper element.

5. The sprinkler assembly of claim 4, wherein the interim arc adjustment mechanism is mounted in the base.

6. The sprinkler assembly of claim 4, wherein the interim arc adjustment mechanism comprises:

a vertically extending sidewall extending upward around a periphery of a top surface thereof and including at least one slot formed therein, the slot configured to receive a portion of the arc of coverage adjustment mechanism; and a horizontal flange extending inward around a central opening, the horizontal flange including at least one notch configured to receive a portion of the upper element such that the interim arc adjustment element rotates with the arc of coverage adjustment element and the upper element.

7. The sprinkler assembly of claim 1 further comprising a flow control element operably connected to the base and accessible from an exterior of the nozzle assembly, the flow control element configured to adjust a flow of water to the nozzle element.

8. The sprinkler assembly of claim 7, wherein the shaft extends through the flow control element.

9. The sprinkler assembly of claim 7, wherein the flow control element comprises:

a lower stationary portion; and an upper rotatable ring mounted in the lower stationary portion such that rotation of the upper rotatable ring relative to the lower stationary portion adjusts an amount of water that flow to the nozzle element.

10. The sprinkler assembly of claim 9, wherein the lower stationary portion comprises a lower portion including at least one first flow opening and the upper rotatable ring includes a lower portion include at least a second flow opening.

11. The sprinkler assembly of claim 10, wherein the upper rotatable ring is rotatable from a first position in which the first flow opening is aligned with the second flow opening to allow flow of water and a second position in which the first flow opening is out of alignment with the second flow opening to disrupt the flow of water.

12. A sprinkler assembly comprises:

a base;

a nozzle element mounted in the base and including an arcuate opening through which a stream of water passes, wherein the nozzle element further comprises:

a lower stationary valve element including:

a cylindrical lower portion;

a conical upper portion, the conical upper portion including:

a stepped and spiraled top surface;

a radially extending rib;

a disk shaped middle element including one or more openings formed therein around a portion of the disk shaped middle element; and an upper element rotatably mounted on the disk shaped middle element, the upper element including:

a vertically extending element extending from a top surface of the upper element, wherein the vertically extending element rotates between a first position and a second position to vary a length of the arcuate opening defined between the vertically extending element and the radially extending rib to vary the arc of coverage of the sprinkler assembly;

an arc of coverage adjustment element mounted in the base and operatively connected to the nozzle element and accessible from an exterior of the nozzle assembly to expand and contract the arcuate opening in the nozzle element to adjust an arc of coverage provided by the stream of water provided by the nozzle element;

a shaft extending through the base, the nozzle element, and the arc of coverage adjustment element and extending above the base, the shaft axially movable relative to the base; and a rotating distributor mounted on a top end of the shaft and rotatable with respect thereto, the rotating distributor positioned to receive the stream of water and distribute the water is outward and away from the nozzle assembly in the arc of coverage.

* * * * *